US006702153B2

(12) United States Patent
Nowak et al.

(10) Patent No.: US 6,702,153 B2
(45) Date of Patent: Mar. 9, 2004

(54) BEVERAGE DISPENSER WITH FAUCET ASSEMBLY

(75) Inventors: Christopher Nowak, Mundelein, IL (US); Zbigniew G. Lassota, Long Grove, IL (US)

(73) Assignee: Food Equipment Technologies Company, Inc., Lincolnshire, IL (US)

( * ) Notice: Subject to any disclaimer, the term of this patent is extended or adjusted under 35 U.S.C. 154(b) by 0 days.

(21) Appl. No.: 09/932,572

(22) Filed: Aug. 16, 2001

(65) Prior Publication Data

US 2003/0071066 A1 Apr. 17, 2003

(51) Int. Cl.[7] ..... B67D 5/06
(52) U.S. Cl. ..... 222/185.1; 222/560; 222/570
(58) Field of Search ..... 222/181.5, 517, 222/560, 570

(56) References Cited

U.S. PATENT DOCUMENTS 1,677,221 A * 7/1928 Wertheimer ..... 222/185.1
5,222,631 A * 6/1993 Hood ..... 222/131
5,370,276 A * 12/1994 Burrows ..... 222/146.1
6,089,409 A * 7/2000 Hart et al. ..... 222/146.5
6,131,767 A * 10/2000 Savage et al. ..... 222/1

* cited by examiner

*Primary Examiner*—Joseph A. Kaufman
(74) *Attorney, Agent, or Firm*—James W. Potthast; Potthast & Associates

(57) ABSTRACT

A beverage dispenser (20) with a faucet assembly (42) manually removably attached to an integral, stainless steel, U-shaped outlet pipe (52) having a generally horizontal section (74) that extends outwardly from the enveloping side (76) has a faucet with a faucet shank (48) for mating overlapping connection with the horizontal section (74) and a faucet latch member (78) carried by the faucet shank (48) and a mating outlet pipe latch assembly (90,92) for releasable latching engagement with the faucet latch member (78) to releaseably lock the faucet shank (48) to the outlet pipe (52). A faucet guard assembly (60, 60') with a generally horizontal section (144) secured to the bottom (26) of the dispenser (20) has a lowermost guard surface (142) located at or beneath a lowermost portion of the faucet nozzle (50) to prevent snagging of the faucet nozzle (50) with the inside of a cup held up to the nozzle for receipt of beverage from beneath the nozzle, and an upturned section (124) in front of the faucet (46) that is at least partly transparent to enable viewing of the nozzle from in front of the guard and may carry a removable U-shaped beverage name or product label (130).

52 Claims, 6 Drawing Sheets

BEVERAGE DISPENSER WITH FAUCET ASSEMBLY

BACKGROUND OF THE INVENTION

1. Field of the Invention

This invention generally relates to beverage dispensers and more particularly to beverage dispensers with faucet assemblies for manual dispensing of beverage from the bottom of the dispenser body and to faucet guards of such faucet assemblies 2. Discussion of the Prior Art Beverage dispensers of the type with a hollow body for containing the beverage and a base for supporting the body above a support surface such as a counter top and which also have a manually operated faucet for dispensing beverage from the bottom of the hollow body are well known. In known hot beverage dispensers, such faucets are connected to a horizontal, radial, faucet pipe extending outwardly from a lower portion of a dispenser housing located beneath the bottom of the hollow body. The faucet pipe is connected to a vertical drainpipe that extends downwardly from an outlet at the lowermost surface of the bottom of the hollow body. Both the faucet pipe and the drainpipe are generally made of relatively rigid, stainless steel or other like metal alloy or other material that is relatively rigid and self-supporting and which is impervious to hot corrosive liquids and steam. Unfortunately, in known hot drink dispensers, the connection between the stainless steel drainpipe and the stainless steel faucet pipe is made by means of separate connection such as a flexible, resilient and generally non-rigid tube made of plastic or the like. Disadvantageously, known non-integral connection between the drainpipe and the faucet pipe presents some problems of cleaning and durability.

Also, in known hot beverage dispensers, the faucet is connected to the outwardly extending, horizontal, faucet pipe by means of a faucet inlet pipe within which is received the faucet pipe and secured by means of mechanical fasteners. The mechanical fasteners, such as bolts or screws, require tools, sometimes special tools to unfasten the faucet from the faucet pipe, as is needed from time to time for purposes of cleaning. Periodic cleaning easy cleaning of the faucet, the faucet pipe, the drain pipe, the U-shaped connecting tube, the interior of the hollow body and the outer surface of the housing supporting and enclosing the hollow, and generally insulated body, is necessary for health purposes. Unfortunately, because of the difficulty of removing the faucet from the faucet pipe this is done less frequently than may be desired. The drainpipe and the faucet pipe are cleaned by using hot water and manually brushing the inside surface of the pipes. While the pipes are relatively impervious to this mechanical brushing, the U-shape tube can be struck with the end of the brush and damaged. Generally, the U-shaped tube is prone to wear and deterioration while the stainless steel tubes are not.

SUMMARY OF THE INVENTION

In accordance with the beverage dispenser and method of the present invention the aforementioned problems and disadvantages of the known beverage dispensers.

This is achieved in part by providing in a hot beverage dispenser having a hollow body having a top, bottom, an enveloping side wall extending between the top and the bottom and a base for supporting the bottom above a support surface with a manually removable faucet assembly having an outlet pipe connected to the bottom of the hollow body and having a generally horizontal section that extends outwardly from the enveloping side, a faucet with a faucet shank for mating overlapping connection with the horizontal section, a faucet latch member carried by the faucet shank, and a mating outlet pipe latch assembly for releasable latching engagement with the faucet latch member to releaseably lock the faucet shank to the outlet pipe by selectively preventing separation of the shank from the outlet pipe.

Preferably, the entire outlet pipe is entirely made of stainless steel or other like metal, and has a generally vertical section connected to the bottom of the hollow body, and an elbow section interconnecting the generally vertical section with the horizontal section. The vertical section, the elbow section and the horizontal section are integrally formed together from a single piece of metal pipe. The faucet shank includes an annular slot facing outwardly from a free end of the faucet shank joined to an inwardly facing cylindrical slot communicating between an interior end portion of the annular slot and the interior of the faucet shank, and an O-ring fitted within the outwardly facing annular slot and partially extending inwardly into the interior of the faucet shank for sealing engagement with the outlet pipe when received within the faucet shank.

Preferably, the blocking member has a radially outwardly facing rotary latch receiving slot, and the latch member has a radially inwardly facing rotary latch connector for sliding mating receipt within the rotary latch receiving slot. A rotary latch connector has a pair of resilient, radially extending, generally parallel latch fingers with free ends having cam surfaces for engagement with opposite sides of a rotary latch receiving slot to push the fingers together during insertion into the rotary latch receiving slot.

The objective is also achieved with respect to the known faucet guard assemblies by providing a beverage dispenser of hot beverage with a hollow body having a top, bottom, an enveloping side wall extending between the top and the bottom and a base for supporting the bottom above a support surface, with a faucet assembly having an outlet pipe connected to the bottom of the hollow body and having a generally horizontal section that extends outwardly from the enveloping side, a faucet with a faucet shank for connection with the horizontal section and a nozzle with a distal downwardly facing opening, a faucet guard with a generally horizontal section secured to the bottom with an opening horizontally aligned with the distal downwardly facing opening and having a lowermost guard surface located at or beneath the distal downwardly facing opening to prevent snagging of the faucet nozzle from beneath the nozzle, and an upturned section in front of the faucet. Preferably, the upturned section is transparent.

This objective is also achieved by providing a beverage dispenser with a hollow body having a top, bottom, an enveloping side wall extending between the top and the bottom and a base for supporting the bottom above a support surface with an outlet pipe connected to the bottom of the hollow body and having a generally horizontal section that extends outwardly from the enveloping side, a faucet with a faucet shank for connection with the horizontal section and a nozzle with a distal downwardly facing opening, a faucet guard with a generally horizontal section secured to the bottom with an opening horizontally aligned with the distal downwardly facing opening and having a lowermost guard surface and an upturned section in front of the faucet that is at least partly transparent to enable viewing of the nozzle adjacent the distal downwardly facing opening. Preferably, the upturned section has means for mounting of a label carrying member.

In one form of the faucet guard, instead of being made from transparent material, is made of interconnected elongate frame members shaped in the configuration of a guard and the nozzle end is visible through the space between the members. A horizontal section of the faucet guard is defined by a plurality of the elongate members arranged in a plane and the lowermost surface is defined by the plane defined by lowermost surfaces of the elongate members defining the horizontal section are located beneath the lowermost surface of the faucet nozzle. The faucet guard also preferably includes an upturned section in front of the faucet with a cross bar member supported by two generally vertical members. The cross bar member and the two generally vertical supporting members define a plane that is tilted inwardly toward the faucet to facilitate viewing of the bottom of the nozzle underneath the cross bar member and between the two generally vertical supporting members.

BRIEF DESCRIPTION OF THE DRAWINGS

The foregoing advantageous feature will be described in greater detail and others will be made apparent from the detailed description of the preferred embodiment that is given with reference to the several figures of the drawing, in which.

DETAILED DESCRIPTION

Figure 1:
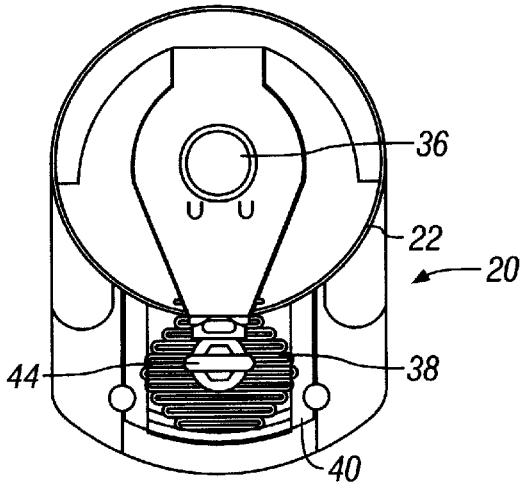
FIG. 1 is a plan view of a preferred embodiment of the beverage dispenser of the present invention showing the drip plate assembly and the relative location of the center of the dispenser body relative to the extent of the anti-tip base assembly.
Figure 2:
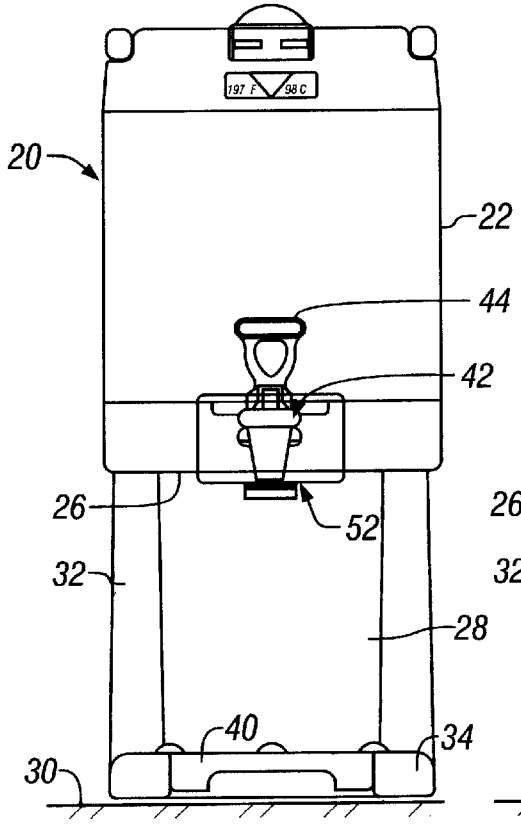
FIG. 2 is a front elevation view of the beverage dispenser of FIG. 1 showing the front of the faucet assembly.
Figure 3:
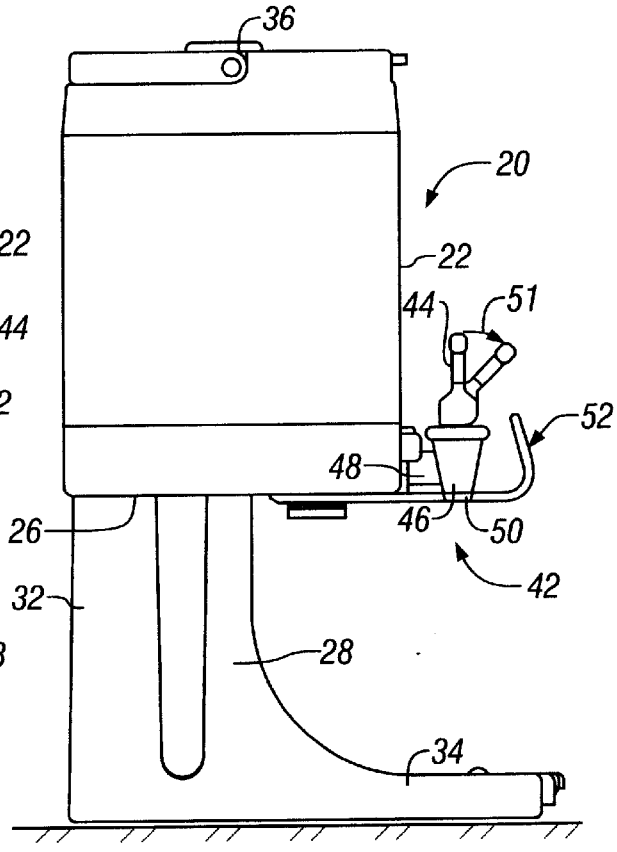
FIG. 3 is a side elevation view of the beverage dispenser of FIGS. 1 and 2 and illustrating again the faucet assembly.

Referring to FIGS. 1–4, the beverage dispenser 20 of the present invention is seen to include a hollow, cylindrical body 22 with a top cover 24, a bottom 26, a base assembly 28 for supporting the body 22 with the bottom elevated above a support surface 30, such as the top of a counter or serving cart. The base assembly 28 has a vertical section 32 extending between the bottom 26 and a forwardly extending horizontal section 34. The cover 24 has an inlet opening 36 through which the beverage, such as hot coffee, may be directly passed into the interior of the hollow body 22. A grate 38 of a drip tray assembly 40 is supported by the horizontal section 34 in a position directly beneath a faucet assembly 42.

The faucet assembly 42 has a pivotally mounted actuation handle 44, attached to the top of a faucet body 46 containing a valve (not shown) operated by the handle 44 that interconnects a hollow inlet faucet shank 48 with a inlet shank with a faucet outlet nozzle 50. The faucet handle 44, the faucet body 46, the valve contained within the faucet body 46, and the outlet nozzle 50 may be conventional and the details with respect to these parts, their assemblage into an operative faucet and how the faucet operates form not part of the invention. Briefly, when the faucet handle 44 is in an upright, non-tilted position as shown in solid line in FIG. 2, the valve is closed, and no beverage passes through the valve from the hollow inlet shank 48 to the outlet nozzle 50. A spring (not shown) located within the body 46 resiliently biases the valve to automatically move this closed position when not being manually held in the open position. When the handle 44 is pivoted in the direction of arrow 51 to the lowered position shown in FIG. 3, the valve is open and beverage within the hollow body is passed through the inlet shank 48, the vale and out of the outlet nozzle 50 and into a suitable container for serving.

Figure 4:
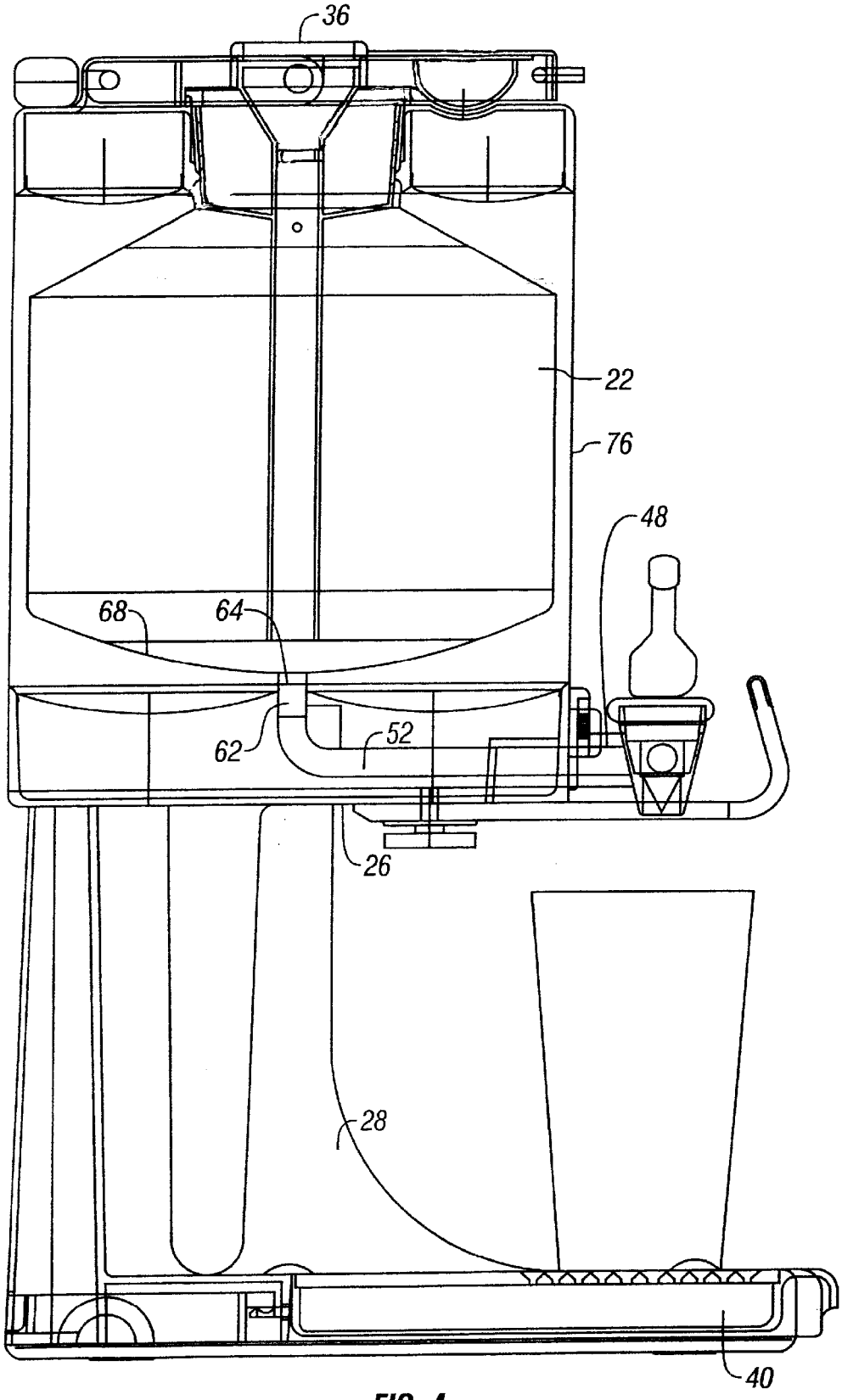
FIG. 4 is a sectional side elevation view of the dispenser of FIG. 3 showing the entire beverage dispenser.
Figure 5:
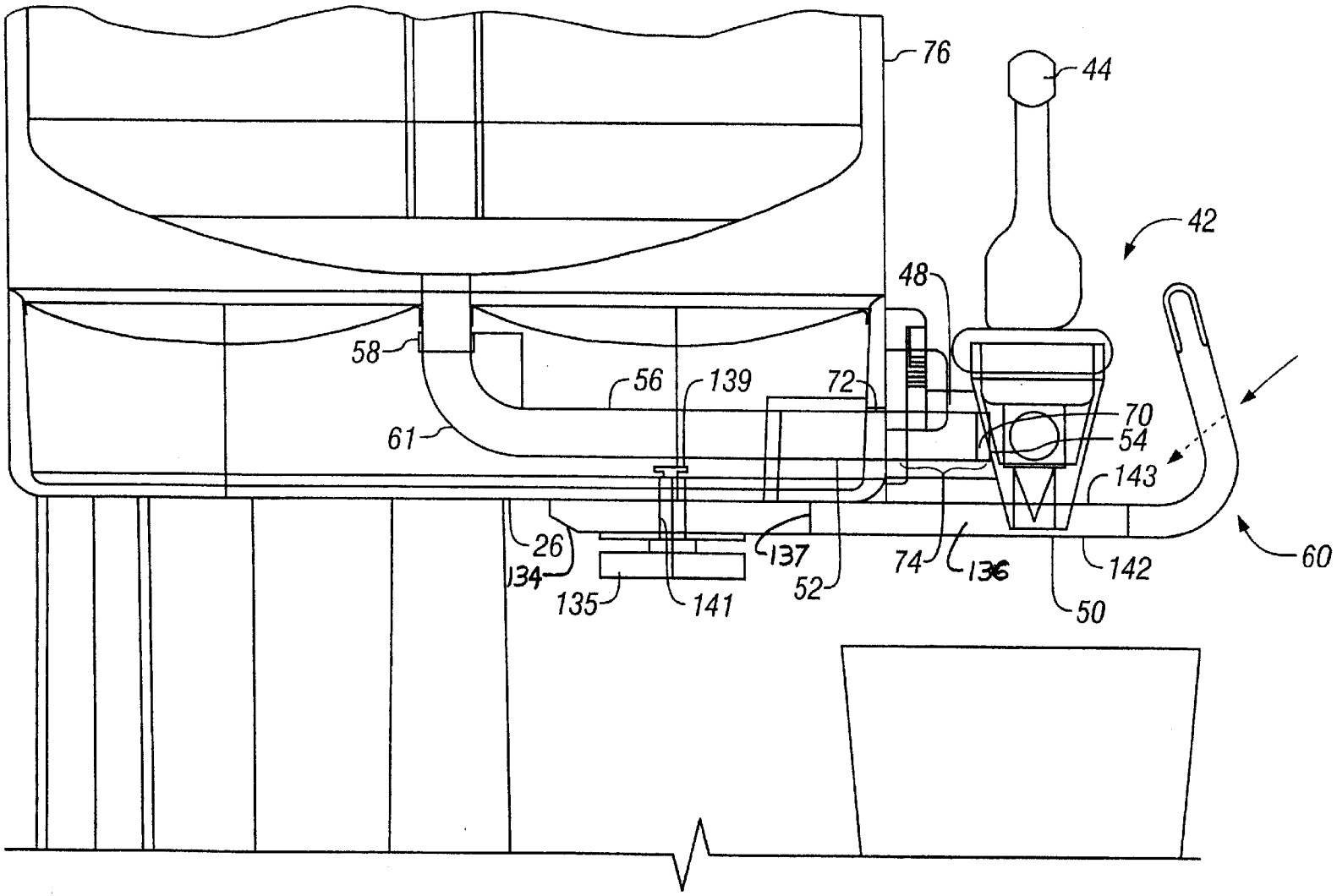
FIG. 5 is a an enlarged portion of the side elevation view of the dispenser of FIG. 3 to better illustrate the faucet assembly and the features noted above with respect to FIG. 3.

Referring also to FIGS. 4 and 5, what is new about the faucet assembly 42 of the present invention and described in detail below includes a special end configuration of the inlet shank 48, a special end configuration of the outlet pipe 52 that interconnects the interior of the hollow body 22 with the inlet shank 48 and a quick release latching and mounting mechanism and method that operate in cooperation with the special end configuration of the shank 48 and of the outlet pipe 52. This cooperation enables the remainder of the faucet assembly 42 to be easily removed manually and to be manually mounted without the use of any tools. Such quick removal enhances the ability to clean the faucet assembly 42, itself, and to clean the interior of the dispenser outlet pipe 52 from the outside of the hollow body 22 with a brush or the like inserted into an outlet end 54 of the outlet pipe 52.

Achieving one aspect of the invention and in keeping with another aspect of the invention, the dispense outlet pipe 52 is made of a single piece of metal, preferably stainless steel, with no non-metal parts. In particular, the there is no fragile connecting joint made of silcon tube-stock or the like at the ninety-degree turn between the horizontal run 56 and the vertical run 58 of the outlet pipe 48 to further facilitate cleaning without risk of damage to the dispense outlet pipe 48. The ninety-degree turn 61 is formed by a piece of the outlet pipe 52 that is integrally formed together with the vertical run 58 and the horizontal run 56. Preferably, the entire outlet pipe 52 is formed of a single piece of stainless steel tube stock that has been turned and cut to size and then machined and flanged.

The inlet end of the dispense pipe 52 is flared to receive another stainless steel connector 62 that interconnects the dispense pipe 52 with the drain hole 64 at the bottom 66 of an insulated liner 68 supported within the hollow body 22 above the bottom 26 to provide space for passage of the dispense pipe. The outlet end of the dispense pipe 52 is especially adapted, or configured, with an inwardly tapered bezel 70 on its outside surface to facilitate easy insertion into the hollow inlet shank 48. The horizontal run 56 of the dispense pipe 48 passes through a sealed opening 72 and has a outward extent 74 that substantially extends beyond the front of the hollow body 22 by preferably no less than an inch at a position adjacent the bottom 26. The faucet assembly 42 is thereby cantilever mounted to the front surface 76 of the hollow body 22.

Figure 6:
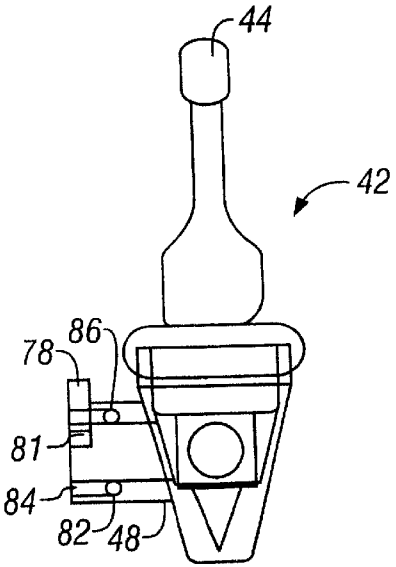
FIG. 6 is a sectional side view of the removable faucet assembly of the present invention when detached from the dispense outlet pipe.
Figure 7:
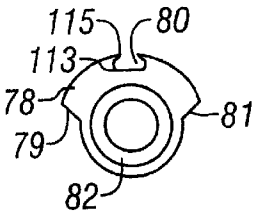
FIG. 7 is a left side elevation view of the inlet pipe, or shank, and female latch connector carried by the shank of the faucet assembly of FIG. 6.

Referring now also to FIGS. 6 and 7, at the inlet end of the hollow inlet shank 48 of the faucet assembly 42 is a rotary interleaving, female, rotary latch member 78. The female latch member 78 is preferably integrally formed at the free, open end of the hollow cylindrical body of the inlet shank 48, and has a generally half annular shape with a latch receipt notch 80 that opens outwardly in a radial direction from the middle of the body of the female latch member 78. The ends 79 and 81 of the female latch member 78 are beveled to form a cam surface to push against the bottom 91 of the slide plate 94 of the latch assembly 92. If the slide plate is in a lowered position, when the faucet shank and the female latch member are rotated 180-degrees the force of the cam surface against the bottom will push the slide plate out of the path of the female latch member so it can reach the top position at which it may be locked against rotation out of the locked position shown in FIG. 5.

The end of the inlet shank is also specially adapted with an O-ring seal assembly including a resilient O-ring 82 received within a cylindrical slot 84 in the open end of the inlet shank 48. An annular slot 86 at the inside of the inlet shank 48 communicates with the cylindrical slot 84, and the O-ring 82 is seated in the annular slot 86 and slightly protrudes into the interior of the inlet shank 48 to engage and seal the outside surface of the outwardly extending portion 74 of the horizontal run 56 of the outlet tube 52 with the interior surface of inlet shank 48. The inwardly beveled surface 70 at the outlet end of the outlet pipe 52 facilitates easy insertion of the outlet end into the inlet shank 48 and prevents the end of the outlet pipe 52 from hitting the side of the O-ring 82 and dislodging or damaging the O-ring 82. Instead, the beveled end slips within the O-ring 82 without touching it and then gradually engages the O-ring 82 in a radially outward direction as the outlet pipe 52 is slid further into the shank 48 and the portion of the outlet pipe 52 within the O-ring gradually changes from the inwardly located surface of the beveled end 70 to the fully O-ring engaged cylindrical surface of the outlet pipe 52, when fully inserted, as shown in FIG. 5. After the O-ring is installed and seated within the annular slot 86, a retainer 88 is inserted into the end of the cylindrical slot 84 to keep the O-ring in place, seated within the annular slot 86.

Figure 9:
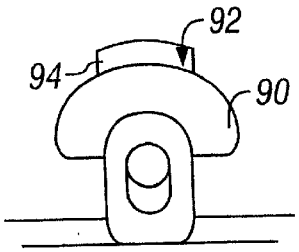
FIG. 9 is a sectional front elevation view of the slide latch assembly as attached to the outlet pipe when in a latched position to prevent axial removal of the faucet shank from the outlet pipe.
Figure 10:
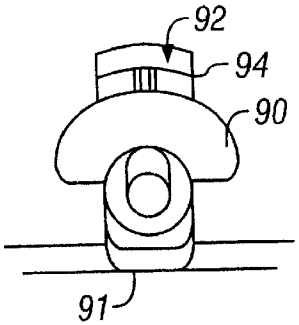
FIG. 10 is another sectional front elevation view of the slide latch assembly similar to that of FIG. 6 but with the slide latch assembly in an unlatched position to enable removal of the faucet shank from the outlet pipe.
Figure 8:
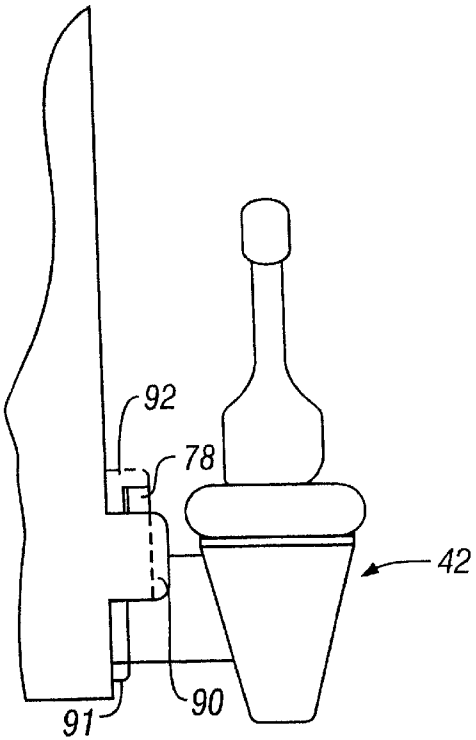
FIG. 8 is an enlarged portion of the side elevation view of the faucet assembly of FIG. 3 to better illustrate how it is attached to and latched to the dispense outlet pipe of the beverage dispenser.
Figure 12:
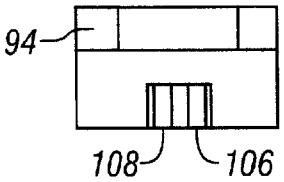
FIG. 12 is a top view of the slide latch member of FIG. 11.
Figure 11:
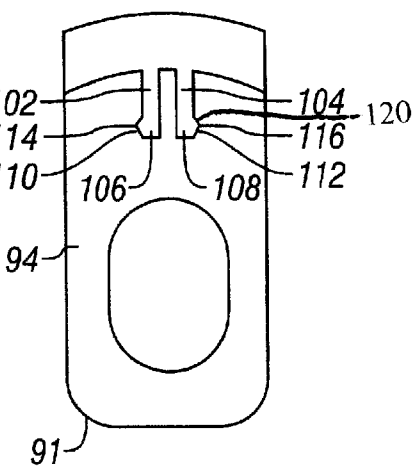
FIG. 11 is a front elevation view of the slide latch member of the latch of FIGS. 9 and 10.
Figure 13:
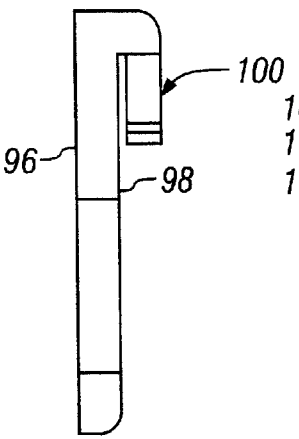
FIG. 13 is a side elevation view of the slide latch member of FIG. 11.

Referring to FIGS. 8, 9 and 10, the front of the body 22 carries a fixed latch member 90 overlying the upper part of the outlet pipe 52 and a slide latch assembly 92. Referring to FIGS. 11, 12 and 13, the slide latch assembly 92 has a slide plate 94 with an elongate slot for receipt of the outlet pipe 52 and the shank 48. As also seen in FIG. 5, the back 96 of the slide plate 94 is located adjacent the front of the hollow body 22. Located in front of the front 98 of the slide plate 94 is a male latch assembly 100. The male assembly has a pair of spaced resilient, downwardly extending fingers 102 and 104. At the free ends of the fingers 102 and 104 and outwardly extending latch members 106 and 108, respectively. At the outer sides of the latch members 106 and 108 are canted cam surfaces 110 and 112. During installation of the faucet assembly 42, the shank 48 is slipped onto the forward extent 74 of the outlet pipe 52 with the top of the handle 44 at the bottom. In this inverted position, the female latch member 78 is enabled to pass beneath the fixed latch member 90. Upon engagement with the bottom 114 of the slide plate 94, the faucet is rotated 180-degrees to rotate the female latch member 90 into a position between the all surface of the fixed latch member 90 and the forward surface of the slide plate 92. When the latch receipt slot 90 is directly beneath the free ends of the fingers 102 and 104, the slide latch is lowered until the latch members 106 and 108 are fully engaged within the latch receipt slot 90. The latch receipt slot 90 has outwardly extending pockets 111 and 113 within which are snugly received the outwardly extending latch members 106 and 108 when fully latched. When the slide latch 92 is lowered, the canted cam surfaces 111 and 113 are engaged by the opposite sides of the inlet 115 to the latch receipt notch 80, and the fingers 102 and 104 are thereby squeezed together until the peaks 114 and 116 of cam surfaces pass the inlet 115 and the fingers 102 and 104 resiliently snap outwardly with the latch members 106 and 108 snugly received within the outwardly extending pockets 111 and 113. When fully latched, the faucet assembly 42 is prevented from rotating away from the fully upright, operating position to an inverted, removal position in which its removal is not blocked by engagement of the fixed latch member 90 with the female latch member 78. The latched position is shown in FIG. 9 and the unlatched position is shown in FIG. 10.

In order to unlatch the faucet assembly 42, the slide plate is pushed upwardly from the bottom 118 and the cam surfaces 120 and 130 above the peaks 114 and 116 squeeze together the fingers 102 and 104 until the peaks 102 and 104 upwardly pass through the inlet of the notch 80. The fingers then return to their non-stressed position shown in FIG. 11 and are again ready for latching by downward movement of the slide plate by pressing downwardly on the top 120 of the slide plate. The slide plate is pushed upwards by the cam surfaces at the ends of the female latch member during rotation of the female latch member to the latch position.

Figure 15:
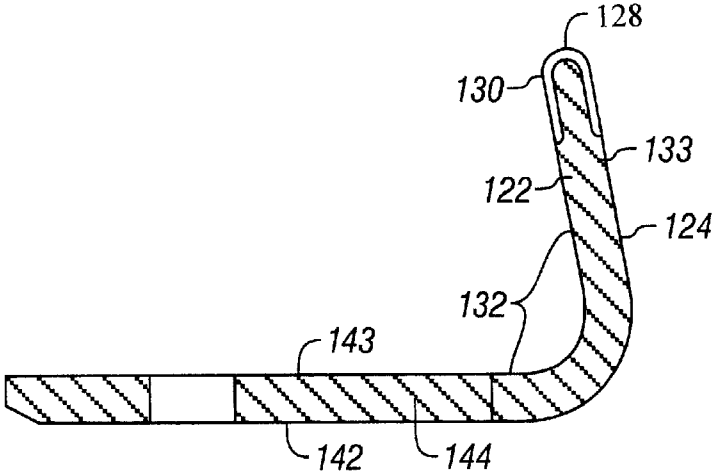
FIG. 15 is a side view of the faucet guard of FIG. 14.
Figure 14:
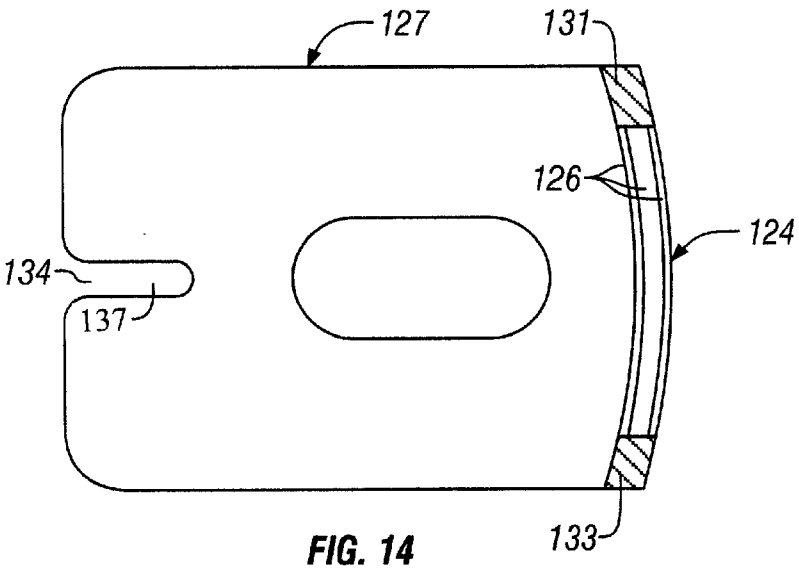
FIG. 14 is a plan view of the faucet guard also seen if FIGS. 2–5.

Referring now to FIGS. 14 and 15, another object of the invention is achieved by providing a faucet guard assembly 52. Unlike known faucet guards, all or a portion of the faucet guard is transparent to enable better visual access to the bottom of the faucet 42 to help users properly align and locate cups and other containers directly beneath the dispense outlet 50 of the faucet assembly 42. At least part 122 of an upstanding portion 124 of a generally L-shaped guard member 127 is transparent. In addition, the upstanding portion 124 is slanted upwardly and inwardly from a position substantially forward of the faucet assembly 42 to facilitate viewing of the faucet through the transparent portion of the upstanding portion. An insert for carrying trademark or beverage name or the like is either limited to the uppermost part of the upstanding portion 124, or the opaque portion is so limited. Preferably, the entire guard member 127 is integrally formed and also made of any suitable material that is not only transparent but also can be used in contact with food and can withstand high temperatures and humidity without deterioration.

The upper part of the upstanding portion 122 has a detent or hollow section 126 adapted for receipt of U-shaped advertising or beverage name insert in the form of a U-shaped, resilient, snap-on plastic member 130. If the insert extends down to distal end 131, then snap on member 130 may also be transparent and may have a transparent background to enable both viewing of the advertising, logos or labels and visual access to the bottom of the faucet 42. Alternatively, the snap-on member 130, itself, or the opaque portion of the snap-on member, only extends to location 133 which is sufficiently close to the top 128 of the upstanding portion 122 of the guard assembly to preclude blocking a line of sight through the transparent portion of the bottom 50 of the faucet. Even if the entire member 130 is opaque, visual access is still improved due to the transparent section 132 beneath the member 130 as well as side windows 131 and 133. If desired, the advertising insert member 130 may be easily removed entirely and the guard member 127 used with the detent 130 for the advertising insert member 130 but without the advertising member 130, itself. The detent may be eliminated if an advertising insert is not desired, or an advertising insert may be used without a detent or integrated into the guard.

As best seen in FIG. 5, the faucet guard assembly 42 includes a hand operated threaded fastener 135 that is received within a central, elongate mounting slot 137. The slot 137 has an opening 134 at the back edge of the horizontal mounting plate 136 opposite from the end to which is attached the upstanding portion 122. This opening 134 enables removal and position adjustment of the guard member 127 without separating the threaded fastener 135 from the bottom 26. Preferably, the threaded fastener 135 has an interior blocking member 139 in front of a threaded section to prevent removal of the fastener 135 from the bottom 26 even when no longer in threaded engagement with the screw hole 141 within which it is received. When used to mount the faucet guard assembly 160 of FIGS. 16–18, below, the threaded fastener is received within a corresponding slot 170.

Achieving another object of the invention, as best seen in FIG. 5, unlike known guard assemblies, in the faucet guard assembly 60 of the present invention, the guard member 127 is mounted with the bottom of the faucet assembly 42 slightly above the bottom surface 142 of the horizontal guard plate 144. Preferably, the faucet outlet 50 is located between top surface 143 of the horizontal guard plate 127 and the bottom surface 142 of the horizontal guard plate 144. With the top surface 143 of the guard plate 144 being above the dispense outlet 50 upward splashing on top of the horizontal guard plate 144 is reduced relative to the circumstance with the outlet 50 being located above the guard. With the bottom surface 142 of the guard assembly 60 being beneath the dispense outlet 50, the bottom surface 142 prevents inadvertent lateral engagement of a cup or other container with the bottom of the faucet during removal of the cup from beneath the dispense outlet 50. Such lateral engagement, such as can happen with known guards in which the dispense outlet 50 is not flush with or above the bottom surface but instead extends substantially beneath the bottom surface of the horizontal guard member 144.

Figure 17:
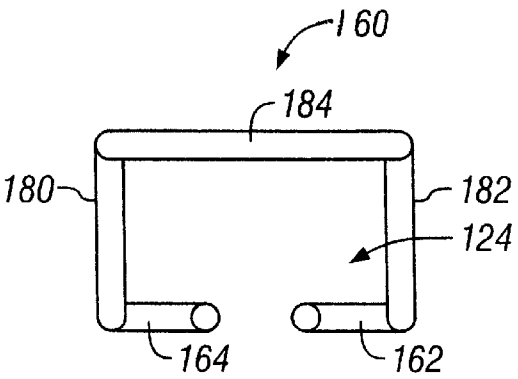
FIG. 17 is a front elevation view of the alternative faucet guard of FIG. 16.
Figure 16:
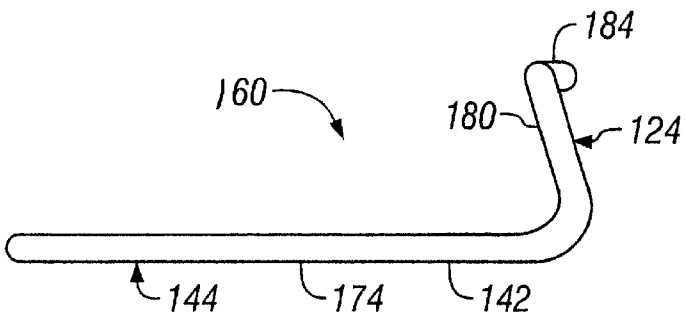
FIG. 16 is a side elevation view of an alternative faucet guard made of bent wire stock instead of transparent plastic.
Figure 18:
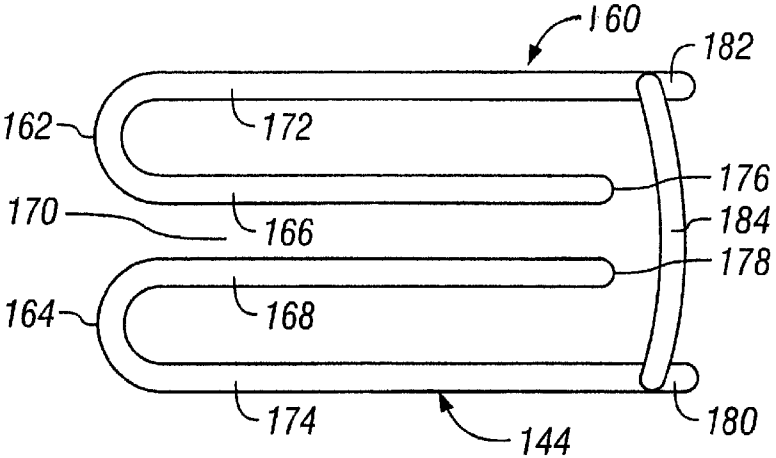
FIG. 18 is a plan view of the alternative faucet guard of FIGS. 16 and 17.

Referring to FIGS. 16, 17 and 18, an alternative faucet guard assembly 160 is seen that is formed from a single, solid-core, stainless steel rod that has been bent into the approximate shape of the perimeter of the faucet guard assembly 60, FIG. 5. The horizontal section is formed of two, parallel, U-shaped rod sections 162 and 164. Inside portions 166 and 168 define a slot 170 corresponding to the slot 134, FIG. 14, of the guard assembly 60 and is similarly engaged by the threaded fastener 135 to attach the guard assembly 160 to the bottom 26 of the beverage dispenser 20. Outer, parallel portions 172 and 174 of the U-shaped members 162 and 164 extend forwardly of the ends 176 and 178 of the inner portions 166 and 168 to provide underlying support for a pair of upstanding sections 180 and 182. The upstanding sections are interconnected by a horizontal cross section 184 that defines the upper edge of the guard. As seen in FIGS. 16 and 18, the cross member 184 is bowed outwardly. As seen in FIG. 16, the upstanding members 180 and 182 are sloped inwardly toward the faucet 42. Thus, the perimeter shape and dimensions of the faucet guard 160 is substantially the same as the faucet guard 60 and if fits relative to the faucet in substantially the same way as shown and described with reference to FIGS. 5 and 11–14. The plane 175 defined by the lowermost surfaces of the U-shaped sections 162 and 164 is at least slightly above the lowermost portion of the nozzle 50 when the faucet guard is properly mounted. The lowermost portion 50 of the nozzle is also visible from in front of the beverage dispenser 20 through the space beneath the cross section 184 and between the upstanding members 180 and 182.

The inward slant of the upstanding members 180 and 182 upstanding sections moves the cross bar 184 closer to the beverage dispenser 20 an out of the way of a clear view of the nozzle end 50. The cross bar 184, in addition to guarding the faucet, may serve the additional function of a handle to facilitate manual manipulation of the dispenser during moving of the dispenser.

While a particular embodiment has been disclosed in detail to illustrate the best mode contemplated of practicing the invention, it should be appreciated that many variations may be made with respect to such details without departing from the scope of the invention as defined in the appended claims.

What is claimed is:

1. A hot beverage dispenser with a beverage containing hollow, rigid, liner body having a top, bottom and an enveloping side wall extending between the top and the bottom of the liner body, a rigid housing protectively enclosing the beverage containing hollow, rigid, liner body and having a housing side wall surrounding the enveloping side wall and a housing bottom located beneath the bottom of the liner body, a base for supporting the housing bottom and the bottom of the hollow body above a support surface, the improvement being a manually removable faucet assembly, comprising:

an outlet pipe connected to the bottom of the hollow body and having a generally horizontal section that extends outwardly from the enveloping side wall and through and outwardly from housing side wall of the rigid housing;

a faucet with a faucet shank for mating overlapping sliding connection with the horizontal section that extends outwardly from the sidewall of the housing;

a faucet latch member carried by the faucet shank; and a mating outlet pipe latch assembly supported outside of the housing side wall and in fixed position adjacent the outwardly extending horizontal section of the outlet pipe for releasable latching engagement with the faucet latch member to releaseably lock the faucet shank to the outlet pipe when the faucet latch member is in a preselected angular position relative to the faucet latch member and the faucet is in an operational position.

2. The beverage dispenser of claim 1 in which the outlet pipe is entirely made of metal.

3. The beverage dispenser of claim 2 in which the outlet pipe is entirely made of stainless steel.

4. The beverage dispenser of claim 2 in which the outlet pipe has a generally vertical section connected to the bottom of the hollow body, and an elbow section interconnecting the generally vertical section with the horizontal section.

5. The beverage dispenser of claim 4 in which the vertical section, the elbow section and the horizontal section are integrally formed together from a single piece of metal pipe.

6. The beverage dispenser of claim 1 in which one of the outlet pipe and the faucet shank has an outer diameter that is dimensioned relative to an inner diameter of the other of the outlet pipe and the faucet shank to facilitate a snug sliding fit of the one of the outlet pipe and the faucet shank received within the other of the outlet pipe and the faucet shank.

7. The beverage dispenser of claim 6 in which the faucet shank includes means for sealing the faucet shank to the outlet pipe.

8. The beverage dispenser of claim 1 in which the faucet latch member extends radially outwardly from the faucet shank adjacent a free end of the faucet shank.

9. The beverage dispenser of claim 8 in which the mating outlet pipe latch assembly includes a blocking member spaced from the housing side to enable receipt of the faucet latch member between the blocking member and the housing side, said blocking member when opposite the faucet latch member engaging the faucet member to prevent sliding separation of the faucet shank from the outlet pipe.

10. The beverage dispenser of claim 1 in which the faucet latch member radially extends outwardly from the faucet shank along approximately half of a circumference of the faucet shank.

11. The beverage dispenser of claim 10 in which the mating outlet pipe latch assembly includes an outwardly extending blocking member that extends outwardly along approximately half of the circumference of the horizontal section of the outlet pipe to engage the faucet latch member when the faucet latch member is radially aligned with the blocking member to prevent relative sliding movement between the outlet pipe and the faucet shank.

12. The beverage dispenser of claim 1 in which the faucet latch member has opposite ends that are slanted relative to a radial direction to enable the ends to cam upwardly a slidable rotary latch connector for preventing relative rotation of the faucet latch member.

13. A hot beverage dispenser with a hollow body having a top, bottom, an enveloping side wall extending between the top and the bottom, a base for supporting the bottom above a support surface, the improvement being a manually removable faucet assembly, comprising:

an outlet pipe connected to the bottom of the hollow body and having a generally horizontal section that extends outwardly from the enveloping side wall;

a faucet with a faucet shank for mating overlapping connection with the horizontal section, one of the outlet pipe and the faucet shank having an outer diameter that is dimensioned relative to an inner diameter of the other of the outlet pipe and the faucet shank to facilitate a snug fit of the one of the outlet pipe and the faucet shank within the other of the outlet pipe and the faucet shank and the faucet shank including means for sealing the faucet shank to the outlet pipe; the sealing means including an annular slot facing outwardly from a free end of the faucet shank joined to an inwardly facing cylindrical slot communicating between an interior end portion of the annular slot and the interior of the faucet shank, and an O-ring fitted within the outwardly facing annular slot and partially extending inwardly into the interior of the faucet shank for sealing engagement with the outlet pipe when received within the faucet shank;

a faucet latch member carried by the faucet shank; and a mating outlet pipe latch assembly for releasable latching engagement with the faucet latch member to releaseably lock the faucet shank to the outlet pipe.

14. The beverage dispenser of claim 13 including a retainer received within the annular slot for blocking removal of the O-ring from the slot.

15. A hot beverage dispenser with a hollow body having a top, bottom, an enveloping side wall extending between the top and the bottom, a base for supporting the bottom above a support surface, the improvement being a manually removable faucet assembly, comprising:

an outlet pipe connected to the bottom of the hollow body and having a generally horizontal section that extends outwardly from the enveloping side wall;

a faucet with a faucet shank for mating overlapping connection with the horizontal section;

a faucet latch member carried by the faucet shank extending radially outwardly from the faucet shank adjacent a free end of the faucet shank; and a mating outlet pipe latch assembly for releasable latching engagement with the faucet latch member to releaseably lock the faucet shank to the outlet pipe including a blocking member spaced from the enveloping side to enable receipt of the faucet latch member between the blocking member and the enveloping side, said blocking member when opposite the faucet latch member engaging the faucet member to prevent sliding separation of the faucet shank from the outlet pipe, and the mating outlet latch assembly including means for selectively preventing relative rotary movement between the outlet pipe and the faucet shank when the faucet latch member is located opposite the blocking member.

16. The beverage dispenser of claim 15 in which the blocking member is mounted to the outlet pipe.

17. The beverage dispenser of claim 15 in which the relative rotation preventing means includes a latch member mounted for movement into rotary movement preventing engagement with the faucet latch member when the faucet latch member is in a preselected angular lock position located between the enveloping side and the blocking member.

18. The beverage dispenser of claim 17 in which the latch member is mounted for sliding movement in a radial direction with respect to the outlet pipe.

19. The beverage dispenser of claim 17 in which the latch member has an elongate slot through which is received in sliding relationship the outlet pipe.

20. The beverage dispenser of claim 17 in which the blocking member has a radially outwardly facing rotary latch receiving slot, and the latch member has a radially inwardly facing rotary latch connector for sliding mating receipt within the rotary latch receiving slot.

21. The beverage dispenser of claim 20 in which the rotary latch connector has a pair of resilient, radially extending, generally parallel latch fingers with free ends having cam surfaces for engagement with opposite sides of the rotary latch receiving slot to push the fingers together during insertion into the rotary latch receiving slot.

22. The beverage dispenser of claim 20 in which the rotary latch connector has a pair of resilient, radially extending, generally parallel latch fingers with free ends having cam surfaces for engagement with opposite sides of the rotary latch receiving slot to push the fingers together during removal from the rotary latch receiving slot.

23. The beverage dispenser of claim 20 in which the rotary latch connector has a pair of resilient, radially extending, generally parallel latch fingers with free ends having outwardly extending cam surfaces, and the latch member receiving slot in the faucet latch member has inwardly extending inlet cam surfaces for engagement with the outwardly extending cam surfaces of the fingers to move the fingers toward each other as the fingers are slide radially into and out of the slot and mating outwardly extending recesses for nestled receipt of the cam surfaces during resilient separation of the fingers after cam surfaces of the fingers pass engagement with the inwardly extending cam surfaces of the inlet of the latch receiving slot.

24. A hot beverage dispenser with a hollow body having a top, bottom, an enveloping side wall extending between the top and the bottom, a base for supporting the bottom above a support surface, the improvement being a manually removable faucet assembly, comprising:

an outlet pipe connected to the bottom of the hollow body and having a generally horizontal section that extends outwardly from the enveloping side wall;

a faucet with a faucet shank for mating overlapping connection with the horizontal section;

a faucet latch member carried by the faucet shank; and a mating outlet pipe latch assembly for releasable latching engagement with the faucet latch member to releaseably lock the faucet shank to the outlet pipe, one of the horizontal section of the outlet pipe and the faucet shank being slideably received within another of the horizontal section and the faucet shank and having an end that is beveled inwardly, and the other having an inwardly extending O-ring for sealing engagement with a side of one of the horizontal section and the faucet shank without damage to the O-ring.

25. In a beverage dispenser of hot beverage dispenser with a hollow body having a top, bottom, an enveloping side wall extending between the top and the bottom and a base for supporting the bottom above a support surface, the improvement being a faucet assembly, comprising:

an outlet pipe connected to the bottom of the hollow body and having a generally horizontal section that extends outwardly from the enveloping side;

a faucet with a faucet shank for connection with the horizontal section and a nozzle with a distal downwardly facing outlet opening;

a faucet guard with a faucet guard body having a generally horizontal section secured to the bottom with an opening for passage of beverage aligned beneath the distal downwardly facing outlet opening and a lowermost guard surface located at or beneath the distal downwardly facing opening to prevent snagging of the faucet nozzle from beneath the nozzle.

26. The beverage dispenser of claim 25 in which faucet guard includes an upturned section in front of the faucet that is substantially transparent.

27. The beverage dispenser of claim 26 in which the lowermost guard surface is substantially transparent.

28. The beverage dispenser of claim 25 in which the upturned section has means for mounting a separate label.

29. The beverage dispenser of claim 25 in which the faucet guard is made of elongate members interconnected to form the faucet guard.

30. The beverage dispenser of claim 29 in which the horizontal section is defined by a plurality of the elongate members arranged in a plane and the lowermost surface is defined by the plane defined by lowermost surfaces of the elongate members defining the horizontal section.

31. The beverage dispenser of claim 30 in which the elongate members of the horizontal section are generally parallel to each other in an aft direction and are spaced no further apart than the approximate width of the top of a coffee cup.

32. The beverage dispenser of claim 29 in which space between the elongate members is substantially empty.

33. The beverage dispenser of claim 29 in which all of the elongate members are integrally formed together of frame stock that has been bent into the faucet guard body.

34. The beverage dispenser of claim 29 in which the faucet guard includes an upturned section in front of the faucet with a cross bar member supported by two generally vertical members.

35. The beverage dispenser of claim 34 in which the cross bar member and the two generally vertical supporting members define a plane that is tilted inwardly toward the faucet to facilitate viewing of the bottom of the nozzle underneath the cross bar member and between the two generally vertical supporting members.

36. The beverage dispenser of claim 25 in which the entire faucet guard consists of the interconnected members and the downwardly facing opening is a gap between the elongate members.

37. In a beverage dispenser of hot beverage dispenser with a hollow body having a top, bottom, an enveloping side wall extending between the top and the bottom and a base for supporting the bottom above a support surface, the improvement being a faucet assembly, comprising:

an outlet pipe connected to the bottom of the hollow body and having a generally horizontal section that extends outwardly from the enveloping side;

a faucet with a faucet shank for connection with the horizontal section and a nozzle with a distal downwardly facing opening;

a faucet guard with a generally horizontal section secured to the bottom with an opening directly aligned with the downwardly facing nozzle opening and an upturned section in front of the faucet that is at least partly transparent.

38. The beverage dispenser of claim 37 including a horizontal section that is at least partly transparent to enable viewing of the distal end of the nozzle.

39. The beverage dispenser of claim 37 in which the horizontal section has a lowermost guard section located at or beneath the distal downwardly facing opening to prevent snagging of the faucet nozzle from beneath the nozzle by blocking movement of an inside of a cup behind the nozzle adjacent the distal end.

40. The beverage dispenser of claim 37 in which the upturned section has means for carrying a separate label.

41. The beverage dispenser of claim 40 in which the carrying means includes an upper portion of the upturned section with a reduced thickness for receipt of a U-shaped label.

42. The beverage dispenser of claim 40 in combination with a U-shaped resilient label that fits over an upper portion of the upturned section.

43. The beverage dispenser of claim 42 in which at least part of the U-shaped label is transparent.

44. The beverage dispenser of claim 42 in which the U-shaped label is located only adjacent the top to not obscure seeing the distal end of the nozzle through the upturned section.

45. The beverage dispenser of claim 37 in which the faucet guard is made of elongate members interconnected to form the faucet guard.

46. The beverage dispenser of claim 45 including a horizontal section defined by a plurality of the elongate members arranged in a plane and the lowermost surface is defined by the plane defined by lowermost surfaces of the elongate members defining the horizontal section.

47. The beverage dispenser of claim 46 in which the elongate members of the horizontal section are generally parallel to each other in an aft direction and are spaced no further apart than the approximate width of the top of a coffee cup.

48. The beverage dispenser of claim 45 in which space between the elongate members is substantially empty.

49. The beverage dispenser of claim 45 in which all of the elongate members are integrally formed together of frame stock that has been bent into the faucet guard body.

50. The beverage dispenser of claim 45 in which the upturned section in front of the faucet has a cross bar member supported by two generally vertical members.

51. The beverage dispenser of claim 50 in which the cross bar member and the two generally vertical supporting members define a plane that is tilted inwardly toward the faucet to facilitate viewing of the bottom of the nozzle underneath the cross bar member and between the two generally vertical supporting members.

52. The beverage dispenser of claim 45 in which the entire faucet guard consists of the interconnected members and the downwardly facing opening is a gap between the elongate members.

* * * * *